US010507520B2

(12) United States Patent
Trumble

(10) Patent No.: US 10,507,520 B2
(45) Date of Patent: Dec. 17, 2019

(54) COPPER-BASED ALLOYS, PROCESSES FOR PRODUCING THE SAME, AND PRODUCTS FORMED THEREFROM

(71) Applicant: Purdue Research Foundation, West Lafayette, IN (US)

(72) Inventor: Kevin Paul Trumble, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 214 days.

(21) Appl. No.: 15/398,509

(22) Filed: Jan. 4, 2017

(65) Prior Publication Data

US 2017/0120323 A1 May 4, 2017

Related U.S. Application Data

(62) Division of application No. 13/441,611, filed on Apr. 6, 2012, now abandoned.

(60) Provisional application No. 61/472,389, filed on Apr. 6, 2011.

(51) Int. Cl.

| | |
|---|---|
| ***B22D 27/04*** | (2006.01) |
| ***C22C 9/05*** | (2006.01) |
| ***C22C 1/02*** | (2006.01) |
| ***B22C 9/06*** | (2006.01) |
| ***B22D 21/00*** | (2006.01) |

(52) U.S. Cl.

CPC ..... *B22D 27/045* (2013.01); *B22C 9/061* (2013.01); *B22D 21/005* (2013.01); *C22C 1/02* (2013.01); *C22C 9/05* (2013.01)

(58) Field of Classification Search

CPC .... B22D 27/045; B22D 21/005; B22C 9/061; C22C 1/03; C22C 9/05; C22C 1/02

See application file for complete search history.

(56) References Cited

U.S. PATENT DOCUMENTS 4,402,906 A * 9/1983 Ueda ..... C22C 9/05 420/470

OTHER PUBLICATIONS

Schievenbusch et al. "Directional Solidification of Near-azeotropic CuMn-alloys: a Model System for the Investigation of Morphology and Segregation Phenomena," ISIJ Int'l vol. 35 (1995) No. 6, pp. 618-623. (Year: 1995).*

* cited by examiner

*Primary Examiner* — Keith Walker

*Assistant Examiner* — John A Hevey

(74) *Attorney, Agent, or Firm* — Hartman Global IP Law; Gary M. Hartman; Domenica N. S. Hartman

(57) ABSTRACT

Processes are provided that include providing a copper-manganese alloy containing copper and manganese and having an amount of manganese that is at least 32 weight percent and not more than 40 weight percent of a combined total amount of the copper and manganese in the copper-manganese alloy, and casting the copper-manganese alloy by multidirectional solidification to produce a product in the form of a casting. The copper-manganese alloy has a composition sufficiently near the congruent melting point of the Cu—Mn alloy system to sufficiently avoid dendritic growth during the multidirectional solidification of the copper-manganese alloy to avoid the formation of microporosity attributable to dendritic growth. The product has a cast microstructure having a cellular and/or planar solidification structure free of dendritic growth and having multidirectional columnar grains.

19 Claims, 6 Drawing Sheets

COPPER-BASED ALLOYS, PROCESSES FOR PRODUCING THE SAME, AND PRODUCTS FORMED THEREFROM

CROSS REFERENCE TO RELATED APPLICATIONS

This is a division patent application of co-pending U.S. patent application Ser. No. 13/441,611, filed Apr. 6, 2012, which claims the benefit of U.S. Provisional Application No. 61/472,389, filed Apr. 6, 2011. The contents of these prior applications are incorporated herein by reference.

BACKGROUND OF THE INVENTION

The present invention generally relates to copper-based alloys that are suitable for use in the production of castings (for example, plumbing castings), wrought forms (for example, produced by rolling, drawing, forging, etc.), and potentially other forms. The invention also relates to the production and processing of such alloys, and particularly processes that are capable of large-scale, efficient production of such alloys.

Copper-based alloys, and particularly brass and bronze alloys, are widely used in a variety of applications, notable but nonlimiting examples of which include plumbing systems. Relatively complex shapes (for example, valves) can be produced by casting brass and bronze alloys. Copper-based casting alloys that contain additions of metals having low melting points relative to copper tend to have very wide freezing ranges, which as used herein refers to the range of temperatures between the solidus temperature (below which the alloy is a solid) and liquidus temperature (above which the alloy is a liquid). The wide freezing ranges of such casting alloys give rise to extensive dendritic solidification and associated chemical segregation and microporosity. As particular examples, casting alloys most commonly used for plumbing applications contain tin (bronze alloys), zinc (brass alloys) and lead, all of which have relatively low melting temperatures compared to copper, with the result that these alloys have wide freezing ranges and are prone to extensive dendritic solidification, chemical segregation and microporosity.

Lead is insoluble in copper and has been used for many years in both cast and wrought copper alloys. Lead is widely considered to "plug" microporosity, which is largely due to the lead itself inducing a wide freezing range. More important, lead is known to improve machinability. In fact, leaded versions of brass and bronze alloys are specified for virtually all components requiring significant machining.

Plumbing component manufacturers are under increasing pressure to remove lead from valves and fittings, whether cast or wrought. As examples, the states of California and Vermont in the U.S.A. currently impose a limitation of 0.25% on the lead content in copper alloys for plumbing components in contact with potable water. In addition, there is a large environmental impact associated with the production of lead and lead-containing alloys. Refinery flue gasses disperse lead in the air and water, foundry furnaces generate airborne lead contaminants, requiring occupational monitoring (for example, blood testing), and lead contaminates the foundry molding sand, rendering it a hazardous solid waste.

The goal of developing lead-free and low-lead brasses and bronzes having the machinability of leaded alloys has been pursued for many years. Although there are many tests for measuring machinability and testing standards are often controversial, none of the alternative alloys developed to date are believed to meet or exceed the machinability of the leaded-brasses. Two main classes of alloys have emerged as the most viable substitutes for leaded brass. The first class encompasses what may be referred to as silicon-brass, which contains small additions of silicon. Commercial examples of these alloys were developed by Mitsubishi Shindoh Co. Ltd., and particular examples that are commercially available under the name Ecobrass® have been reported to have a nominal composition of, by weight, 75Cu-21Zn-3Si. The inclusion of silicon in this brass material results in the formation of hard second phase particles that facilitate chip breakage during machining. The second class encompasses alloys that contain bismuth (similar properties to lead) or both bismuth and selenium. Commercial examples include alloys available from Federal Alloys under the name Federalloy® and are formulated as Bi-substituted versions of common leaded casting brasses. The Federalloy® alloys produce structures akin to leaded brasses, in that bismuth phases form interdendritic pockets that facilitate chip breakage. Similar structures are produced in the Bi—Se alloys of this class. Commercial versions of these alloys, commonly known as "SeBiLoy," often contain, by weight, about 0.5 to about 4% Bi and up to about 1% Se, and have been marketed under the name Envirobrass®. Although exposure to bismuth does not pose the same level of risk as lead, bismuth is a byproduct of lead production, is much more expensive, and is no longer produced in the US. Thus, bismuth-containing alloys do not appear to be an optimal long-term solution to the problem of replacing lead in brass.

Manganese is well known as an alloying element in commercial copper-based alloys, where it enjoys a reputation for enhancing properties for marine-based applications. Manganese bronzes, also known as high-strength yellow brasses (C86XXX) contain up to about 5 weight percent manganese, together with zinc, aluminum, nickel, iron and tin as alloying elements. Certain aluminum bronzes (C957XX) contain about 11 to about 14 weight percent manganese, together with aluminum, nickel and iron as main alloying elements. Two specialty alloys (C99700 and C99710) contain about 11 to about 23 weight percent manganese, together with high zinc concentrations, as well as nickel, iron and lead. Finally, another specialty alloy (C99600) known as Incramute 1, contains 39 to 45 weight percent manganese with 1 to 3 weight percent aluminum and smaller concentrations of other alloying elements.

Manganese-containing copper alloys have also been the subject of academic research. Two examples are Schievenbusch et al., "Directional Solidification of Near-azeotropic Cu Mn-alloys: a Model System for the Investigation of Morphology and Segregation Phenomena," 1S1J International, Vol. 35, No. 6, p. 618-623 (1995), and Zimmermann et al., "Morphology and Segregation Behaviour in Directionally Solidified Copper-Manganese Alloys with Compositions Near the Melting Point Minimum," Materials Science Forum Vol. 215-216, p. 133-140 (1996). These papers investigate Cu—Mn alloy compositions that undergo cellular and dendritic growth during directional solidification as a result of their compositions containing manganese contents that are intentionally above or below the "azeotrope" or (more properly) congruent point or minimum in the liquidus/solidus of the Cu—Mn phase diagram, shown in FIG. 1 (N. A. Goken, "Journal of Alloy Phase Equilibria," 14 [1] p. 76-83 (1993)). Though there is uncertainty regarding the exact composition at the congruent point of the Cu—Mn system, Goken placed the congruent point at 34.6±1.4 weight percent (about 38±2 atomic percent) manganese. The particular focus of the investigations reported by Schievenbusch et al. was directional solidification experiments with alloy (Mn) concentrations within a range of ±5 weight percent around the azeotropic concentration, and the focus of the investigations reported by Zimmermann et al. used manganese concentrations of a few percent below and above the concentration of the melting point (azeotropic) minimum. The resulting microstructures were cellular as well as dendritic, evidenced by secondary arms developing in the microstructures.

BRIEF DESCRIPTION OF THE INVENTION

The present invention provides copper-manganese alloys, optionally with potentially other alloying elements, whose compositions are at or sufficiently near the congruent (minimum) melting point of the Cu—Mn system to substantially avoid dendritic growth during solidification. The present invention also provides processes for producing such alloys, as well as products produced from such alloys.

According to a first aspect of the invention, a copper-manganese alloy is provided that contains copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth.

According to a second aspect of the invention, a process is provided for producing a copper-manganese alloy containing copper and manganese in amounts at or sufficiently near the congruent melting point of the Cu—Mn alloy system to sufficiently avoid dendritic growth during solidification of the copper-manganese alloy to avoid the formation of microporosity attributable to dendritic growth. The process entails combining copper and ferromanganese as a source of manganese.

According to a another aspect of the invention, a process is provided for producing a casting from a copper-manganese alloy containing copper and manganese and having an amount of manganese that is at least 32 weight percent and not more than 40 weight percent of a combined total amount of the copper and manganese in the copper-manganese alloy. The process includes melting the copper-manganese alloy to form a melt, and then pouring the melt into a multidirectional solidification mold to cast a product via multidirectional solidification in the form of a casting. The temperature of the melt decreases toward an ambient temperature established by the mold. The copper-manganese alloy has a composition sufficiently near the congruent melting point of the Cu—Mn alloy system to sufficiently avoid dendritic growth during the multidirectional solidification of the copper-manganese alloy to avoid the formation of microporosity attributable to dendritic growth. The product has a cast microstructure having a cellular and/or planar solidification structure free of dendritic growth and having multidirectional columnar grains.

Other aspects of the invention include articles formed of a copper-manganese alloy having a composition as described above and optionally produced by a process comprising the steps described above. Particular but non-limiting examples are castings, such as complex shape castings.

A technical effect of the invention is that the copper-manganese alloys have a narrow freezing range as compared to other copper alloys, with the result that the alloys contain less chemical segregation and microporosity attributable to dendritic growth during solidification, and therefore are believed to be well suited for producing castings. Furthermore, the copper-manganese alloys have a relatively low melting temperature as compared to many other copper alloys, with the result that the alloys are believed to be especially well suited for complex shape casting (for example, plumbing valves and fittings) due to their high castability. The high concentration and relatively low cost of manganese relative to copper and other alloying elements commonly used in copper alloys also has the advantage of reducing the cost of the copper-manganese alloys of this invention in comparison to conventional copper alloys, and particularly brass and bronze alloys containing lead or bismuth. In view of these considerations, copper-manganese alloys of this invention are believed to be well suited as lead-free copper alloys for use in plumbing applications.

Another technical effect of the invention is the capability of producing copper-manganese alloys of this invention using a process that can be adapted for large scale production and can make use of relatively low-cost ferromanganese as the primary source of manganese in the alloys.

Other aspects and advantages of this invention will be better appreciated from the following detailed description.

DETAILED DESCRIPTION OF THE INVENTION

The present invention provides a class of copper-manganese alloys based around the congruent melting composition of the Cu—Mn binary system, which is believed to be 34.6±1.4 weight percent (about 38±2 atomic percent) manganese and has a melting temperature of about 870° C. In preferred embodiments, the copper-manganese alloys are lead-free, offer high castability for shape casting, and contain sufficiently minimal chemical segregation and microporosity when cast to eliminate the need for lead or other elements to fill the microporosity.

Figure 1:
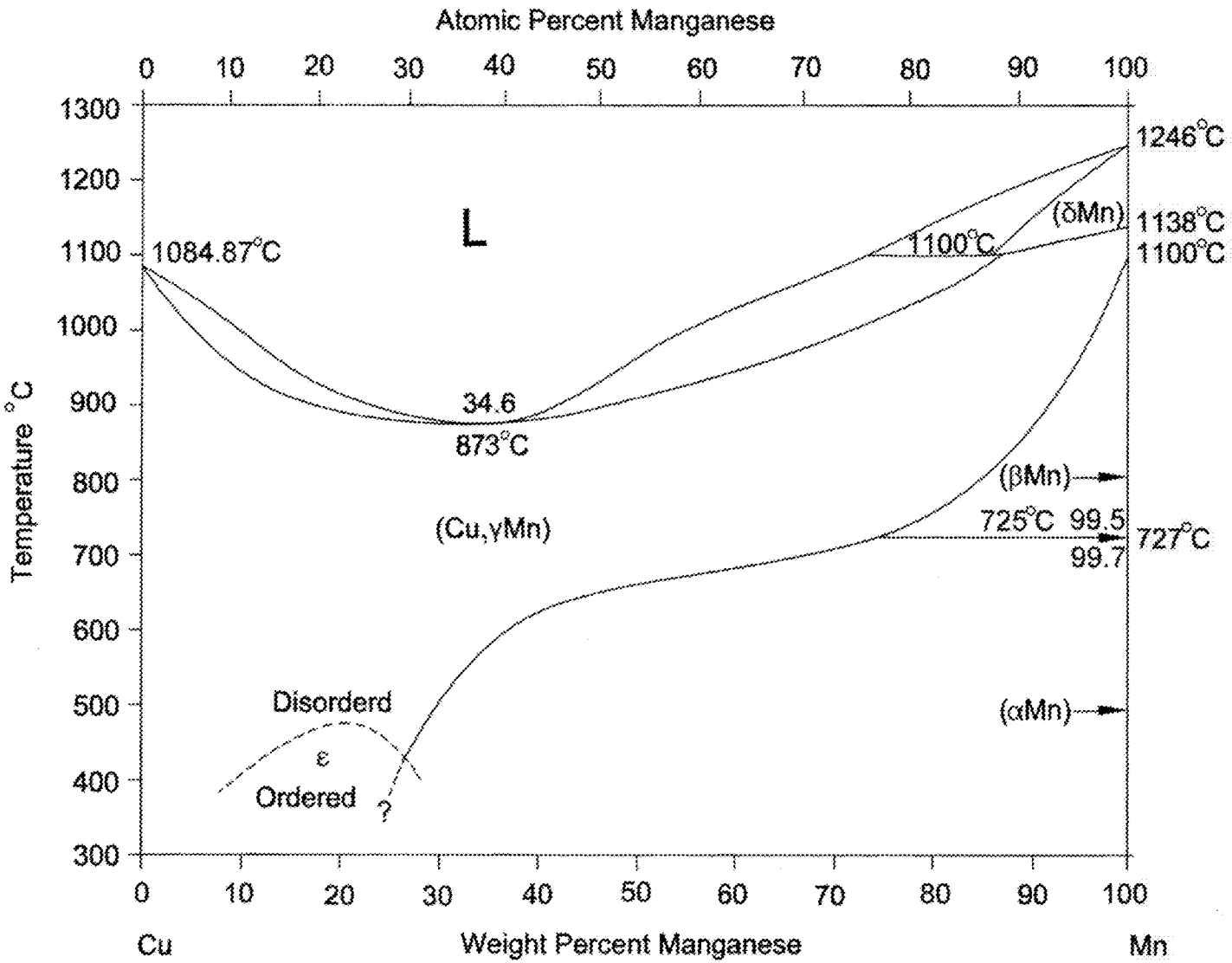
FIG. 1 represents the equilibrium phase diagram of the binary Cu—Mn system.
Figure 2:
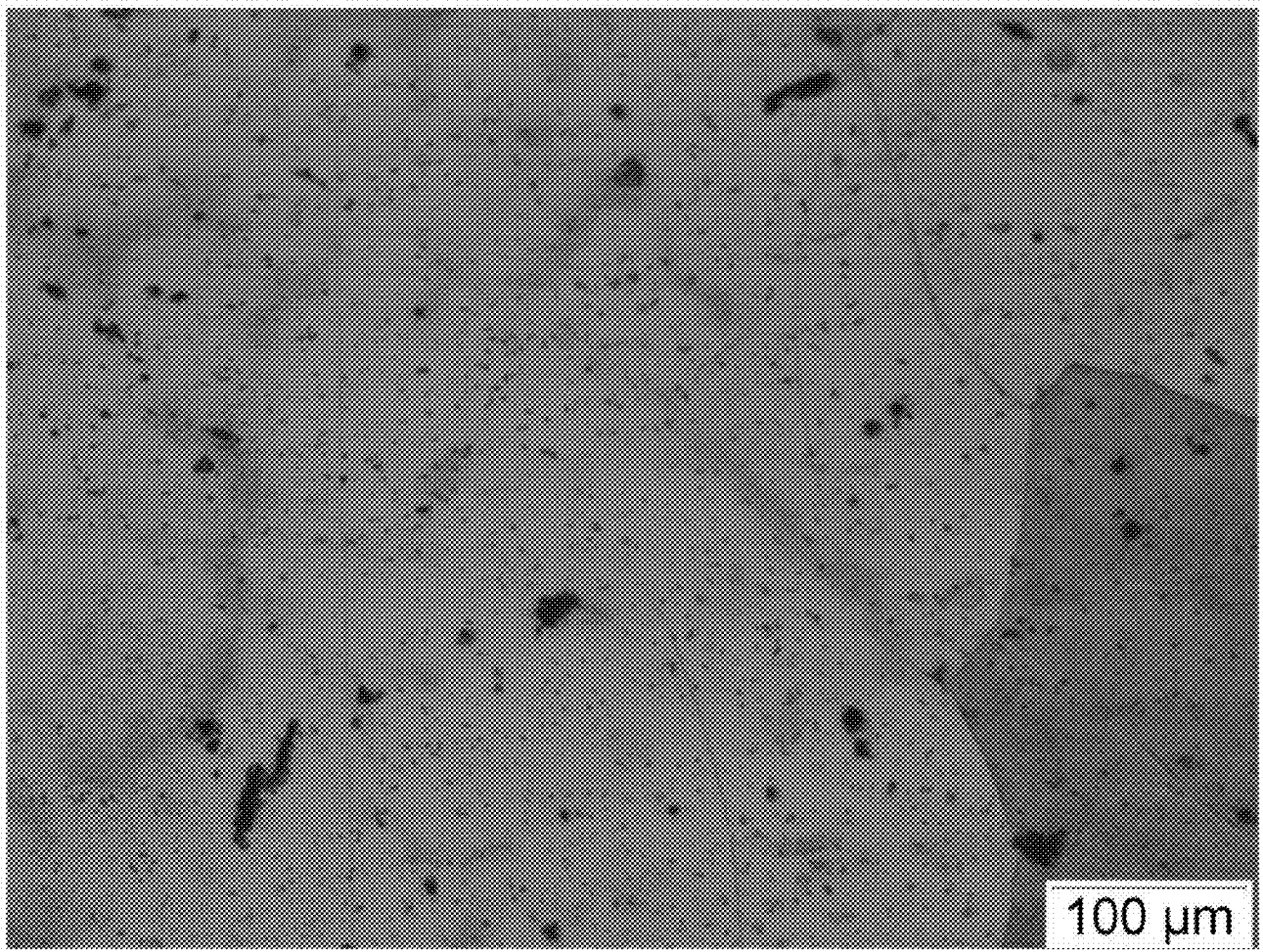
FIGS. 2 through 5 are scanned images of microphotographs of Cu—Mn alloys that were investigated and evidence the onset of non-planar (cellular) growth during solidification but the absence of dendritic growth and structures.

In investigations leading to the present invention, a small heat of a binary Cu—Mn containing 32 weight percent manganese was produced by induction melting in air in a graphite crucible by combining 99.9% pure copper and 99.9% pure electrolytic manganese. After casting the alloy in a small steel ingot mold, metallographic sections of the resulting ingot showed a distinctive brown color and attractive luster when polished. FIG. 2 is an optical micrograph of the binary Cu—Mn alloy following etching, and reveals that the alloy contains a mildly cellular solidification structure, believed to evidence the onset of cellular solidification from planar solidification but without the onset of dendritic solidification. The micrograph also indicates the presence of small amounts of second phase particles that were not identified. Notably, solidification shrinkage microporosity is not present in the as-cast structure, evidencing that the alloy was sufficiently at or near the congruent melting composition of the Cu—Mn binary system to avoid dendritic growth during solidification. More specifically, solidification avoided the onset of non-planar (dendritic) growth and therefore resulted in the mildly cellular solidification structure. The cellular structure (instead of a purely planar structure) was concluded to be the result of the alloy composition likely being on the low-Mn side of the congruent composition, which is believed to be 34.6±1.4 weight percent.

The above results were particularly notable because conventional wisdom is that only slight amounts of solute in a pure metal will render the solidification under typical conditions to be dendritic due to constitutional supercooling (CS). With increasing CS there is a transition from planar to cellular to dendritic solid/liquid interface growth morphology. As a result of the very wide freezing ranges associated with copper-based casting alloys that contain additions of metals having low melting points relative to copper, non-planar dendritic growth promotes chemical segregation and increases the tendency for microporosity. In this and subsequent investigations, it was concluded that the disadvantages of chemical segregation and microporosity could be avoided with copper-manganese alloys whose manganese contents are sufficiently near the congruent melting composition of the Cu—Mn binary system, preferably at least 33.2 to not more than 36 (34.6±1.4) weight percent manganese, to achieve a purely planar growth, possibly cellular growth, or the onset of cellular growth from planar growth. Notably, commercial alloys that exhibit planar or clearly cellular growth during solidification are not believed to exist, or in any event are not common.

Figure 3:
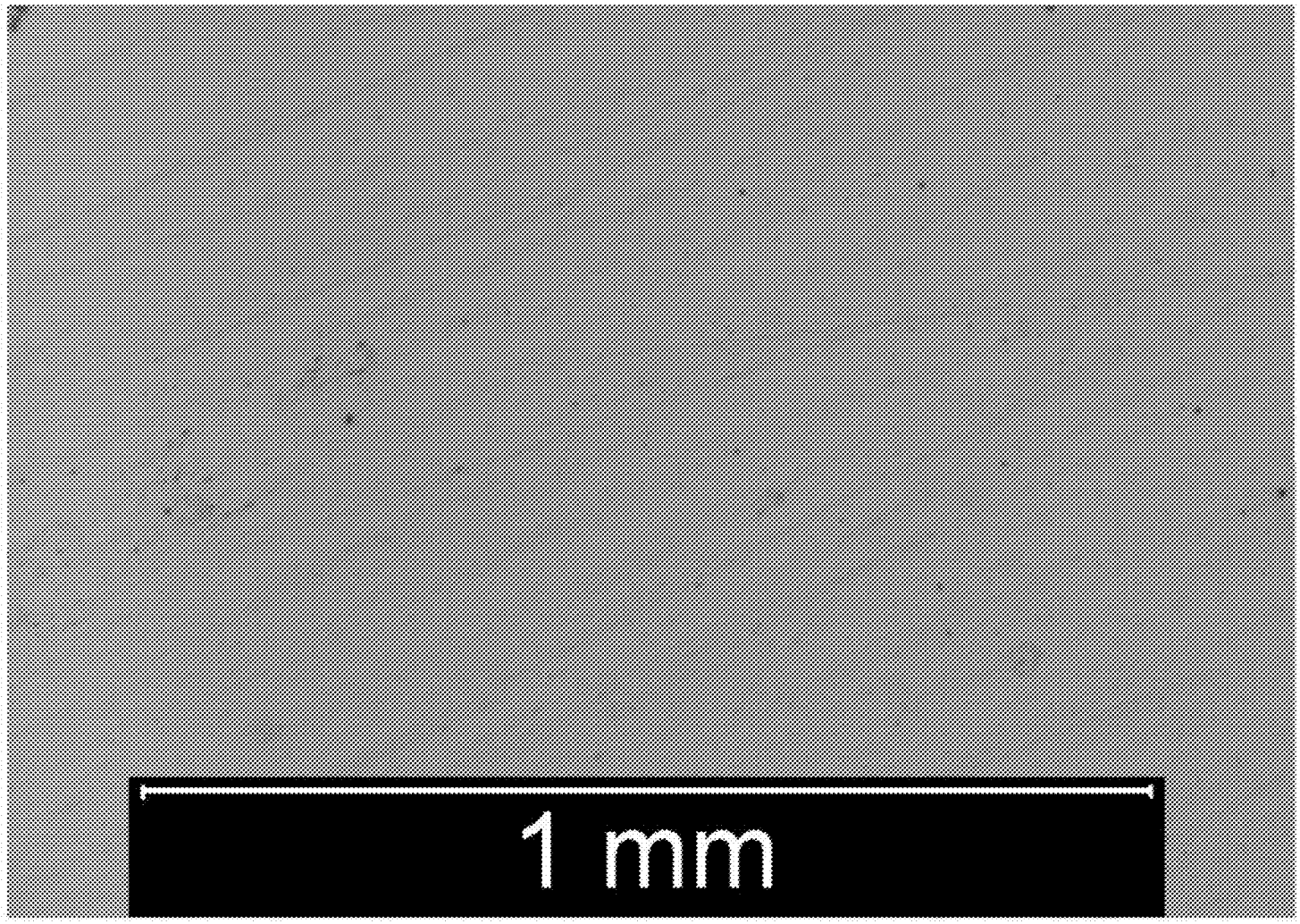
Figure 4:
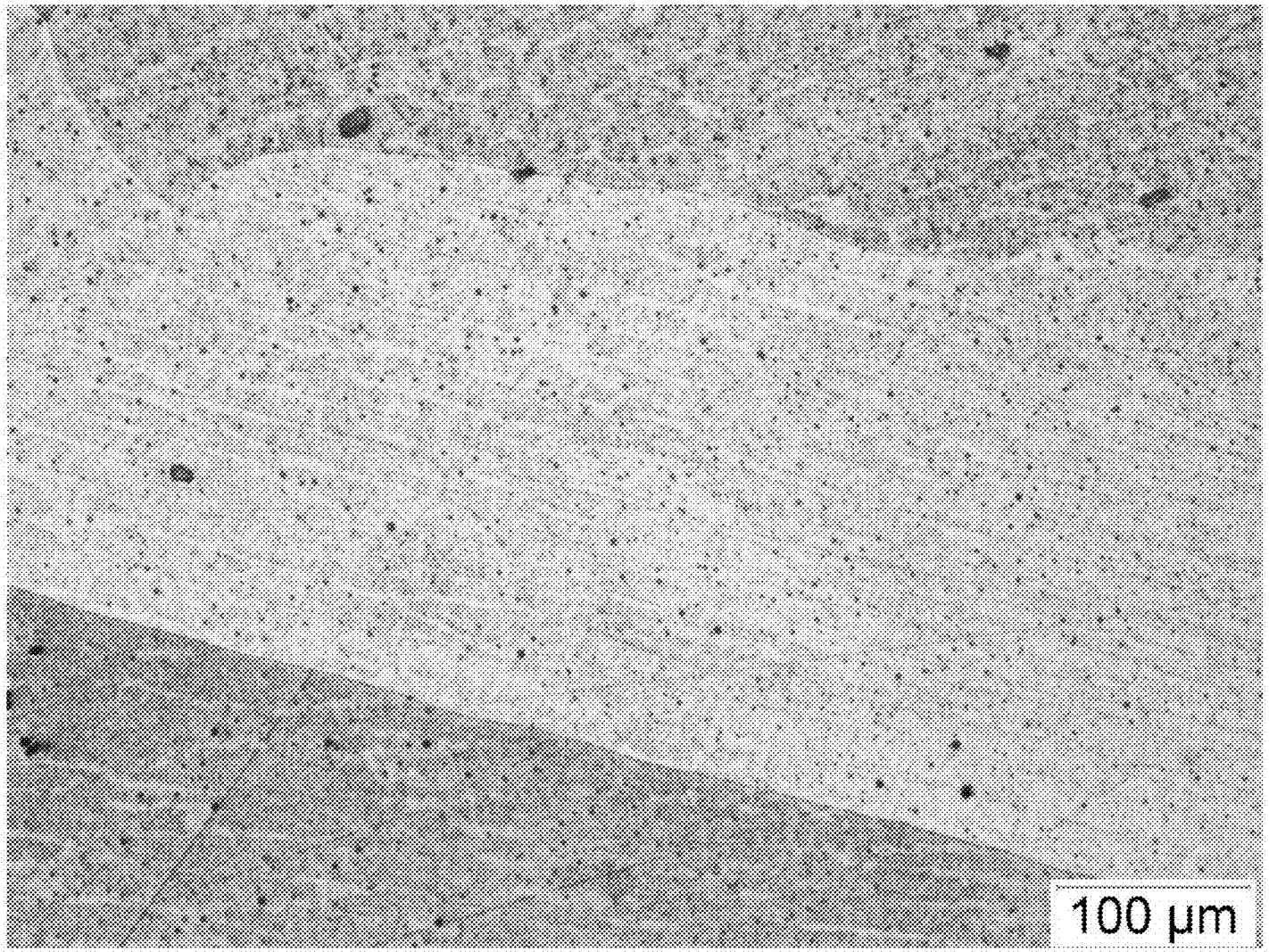
Figure 5:
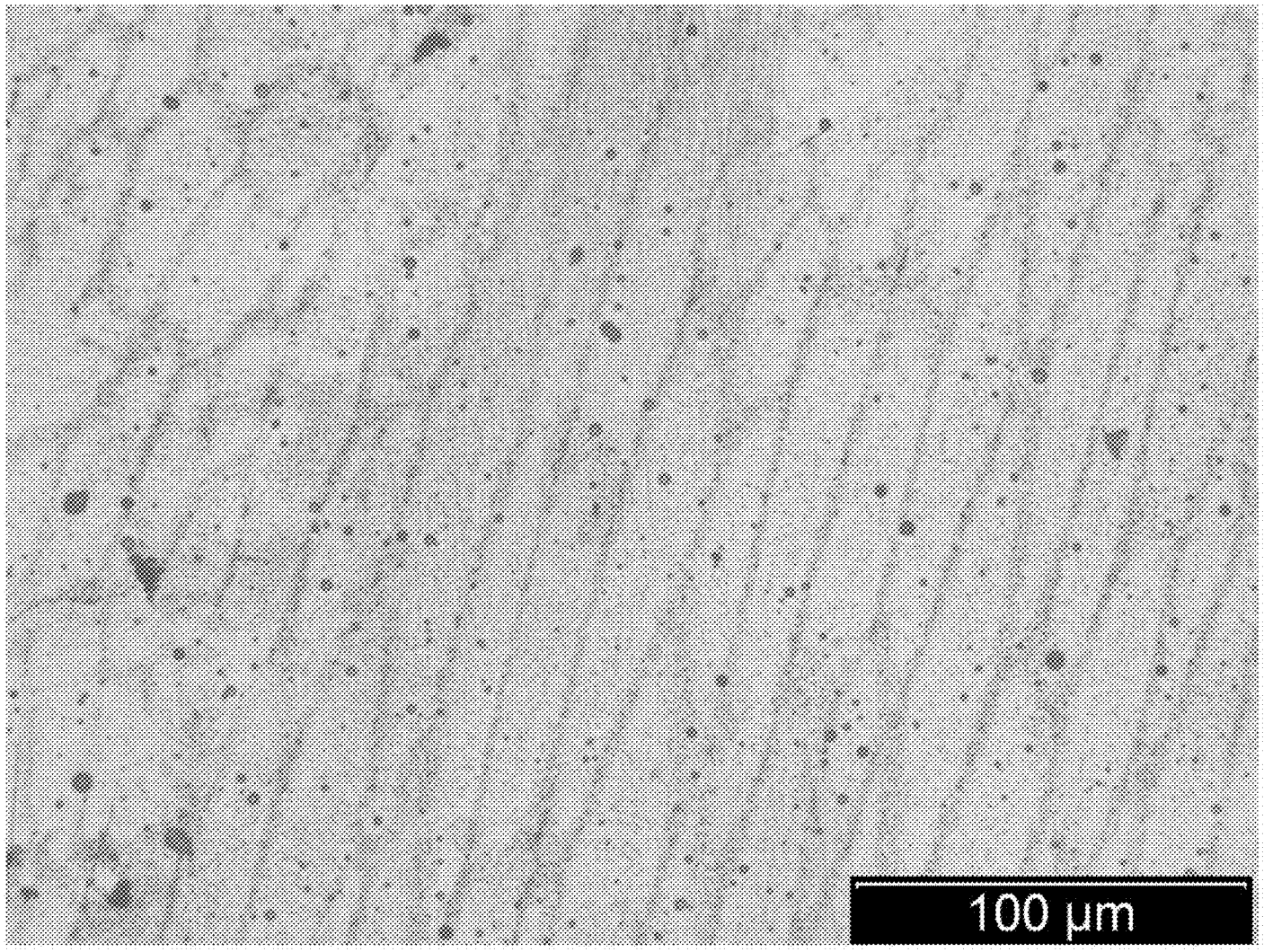

On the basis of the above, additional Cu—Mn compositions were prepared and cast. FIG. 3 is an optical micrograph of a binary Cu—Mn alloy containing 36 weight percent manganese. The polished unetched specimen reveals that the alloy did not contain microporosity. FIG. 4 contains an optical micrograph of a specimen of the same alloy 36% Mn alloy. The specimen was etched, and the micrograph is at a higher magnification than FIG. 3 to reveal a cellular solidification structure. FIG. 5 is another micrograph of the same 36% Mn alloy following etch, but at a higher magnification to reveal the cellular solidification structure more clearly. The micrographs of FIGS. 4 and 5 were concluded to evidence that the 36% Mn alloy was on the high side of the congruent point, and that dendritic growth can be avoided by limiting the manganese content of the copper alloy to levels of at least 32 weight percent to not more than 36 weight percent, and that manganese contents below 32 weight percent and above 36 weight percent would undesirably lead to dendritic growth as well as chemical segregation and microporosity associated therewith in copper alloys. While a range of at least 32 weight percent to not more than 36 weight percent is believed to be preferred, more broadly the invention can encompass manganese contents that sufficiently, though not necessarily completely, avoid dendritic growth during solidification to avoid microporosity that would form as a result of dendritic growth. For this purpose, on the basis of constitutional supercooling criteria, it is believed that manganese contents of as low as 25 weight percent and as high as 40 weight percent may be tolerable.

Another aspect of the congruent melting behavior of the Cu—Mn alloys of this invention is that the congruent melting temperature (about 873° C.) is substantially lower than pure copper (about 1085° C.) and most commercial copper alloys. The low melting temperature has a beneficial effect on "casting fluidity," that is, the ability of the liquid melt to flow and fill fine cavities and thin sections in a casting mold. As the liquid temperature of the melt decreases toward the ambient temperature established by the casting mold, the driving force for heat transfer to the mold and rate of solidification as the metal flows in narrow channels decreases. Casting fluidity, as it is called (not to be confused with "fluidity"=1/viscosity of a liquid) is quantified by pouring or drawing a liquid melt into a fine mold channel at a melt temperature and measuring the length of flow (filling) that occurs before solidification at the entrance chokes off the flow. Pure metals generally have higher casting fluidity than alloys because dendritic solidification in alloys restricts the flow of liquid more than plane-front solidification. On this basis, the effect of the lower melting temperature of the Cu—Mn alloys of this invention are expected to exhibit higher casting fluidity as compared to highly-dendritic copper casting alloys because the congruent-melting Cu—Mn alloys of this invention will not exhibit additional flow resistance attributable to dendritic solidification. In addition, because the melting temperature is flat (shallow or broad) surrounding the congruent melting temperature, this beneficial effect should substantially (if not completely) accrue for Cu—Mn alloy compositions over the range of 32 to 36 weight percent manganese, and not solely the congruent point composition of 34.6 weight percent manganese.

To achieve optimal combinations of properties for particular applications, it is foreseeable that the Cu—Mn alloys of this invention can be alloyed if the atomic ratio of copper and manganese is maintained to achieve a structure that is a purely planar, purely cellular, or a combination thereof (free of non-planar dendritic growth). Notable examples of additional alloying constituents include iron, nickel, aluminum, silicon, tin and other alloying elements that may benefit copper alloys. For applications in which lead is acceptable, the Cu—Mn alloys may also be alloyed to contain lead.

In particular embodiments in which the Cu—Mn alloy is to be used in shape casting, for example, in the production of plumbing valves and fittings, chemical optimization is based at least in part on castability (microporosity and susceptibility to hot-tearing), corrosion resistance, machinability, mechanical properties, and cost. The Cu—Mn alloys of this invention may also offer certain advantages over existing copper alloys when produced in wrought form, for example, by rolling, drawing or forging.

Figure 6:
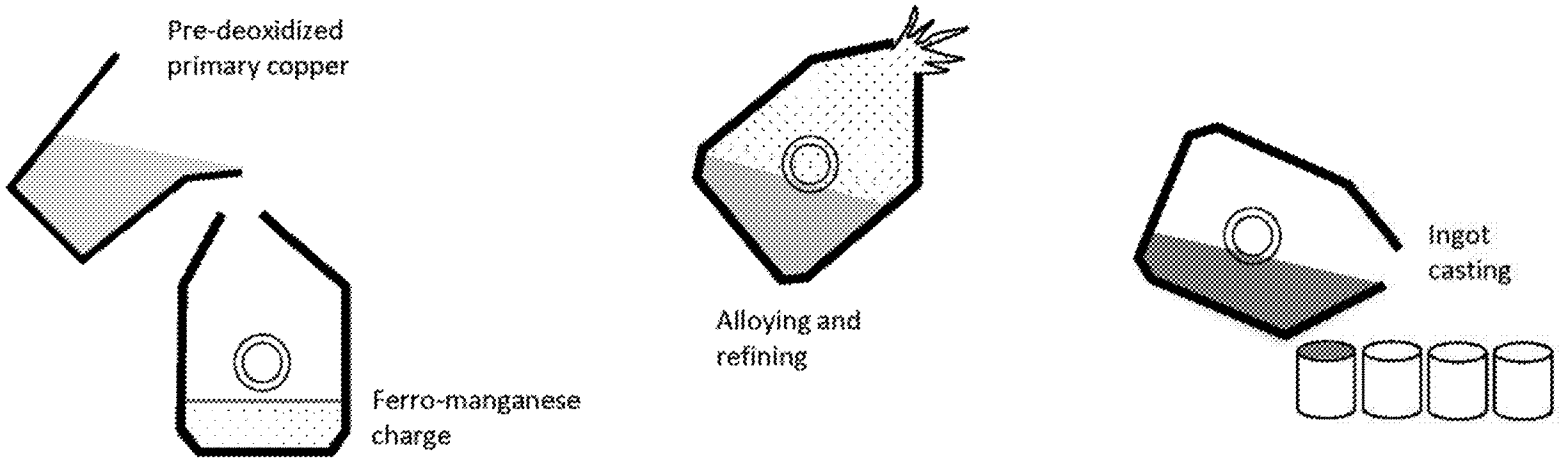
FIG. 6 schematically represents a large-scale Cu—Mn alloy production process in accordance with an embodiment of the present invention.

The invention also contemplates large-scale production processes for producing the Cu—Mn-based alloys. In one particular example, partially refined copper is used and the source of manganese is ferromanganese. As known in the art, ferromanganese is partially refined manganese, for example, containing about 75 to 80 weight percent manganese with the balance primarily carbon (for example, about 7 weight percent) and iron (in other words, the balance incidental impurities). Ferromanganese is used in the production of the vast majority of steels, and its cost is far less than copper. The final step in refining primary copper is deoxidation, usually by reaction with carbon or hydrocarbon. In the particular example disclosed herein, solid ferromanganese is reacted with primary copper that has not been deoxidized, and the heat generated by oxidation of the carbon in the ferromanganese is employed to melt and dissolve the ferromanganese. Such a process is schematically represented in FIG. 6. The process thus utilizes an intermediate product of the existing large-scale copper refining technology in a manner that enables a low-cost method of alloying manganese and copper. A consequence of this particular process is that the resulting alloy contains a small amount of iron from the ferromanganese.

Though both cast and wrought forms of the Cu—Mn alloys are envisioned for plumbing applications, other forms and applications of the Cu—Mn alloys are also foreseeable. Furthermore, thermomechanical processing and heat treatment can be adapted to develop higher strengths in these alloys for structural applications. It is also foreseeable that the alloys may have appeal for decorative applications on the basis of the intrinsic distinctive brown color of the pure binary alloy.

While the invention has been described in terms of specific embodiments, it is apparent that other forms could be adopted by one skilled in the art. Therefore, the scope of the invention is to be limited only by the following claims.

The invention claimed is:

1. A process comprising:

combining copper and ferromanganese to form a copper-manganese alloy, the ferromanganese containing about 75 to 80 weight percent manganese with the balance carbon, iron, and incidental impurities, the copper-manganese alloy containing copper and manganese and having an amount of manganese that is at least 32 weight percent and not more than 40 weight percent of a combined total amount of the copper and manganese in the copper-manganese alloy; and casting the copper-manganese alloy by multidirectional solidification at an uncontrolled solidification rate to produce a product in the form of a casting, the copper-manganese alloy having a composition sufficiently near the congruent melting point of the Cu—Mn alloy system to sufficiently avoid dendritic growth during the multidirectional solidification of the copper-manganese alloy to avoid the formation of microporosity attributable to dendritic growth, the product having a cast microstructure having a cellular and/or planar solidification structure and having multidirectional columnar grains.

2. The process according to claim 1, wherein the copper-manganese alloy contains at least 32 weight percent and not more than 36 weight percent manganese.

3. The process according to claim 1, wherein the copper-manganese alloy further contains one or more of iron, nickel, aluminum, silicon, tin, and lead.

4. The process according to claim 1, wherein the copper-manganese alloy does not contain lead.

5. The process according to claim 1, wherein the product is free of microporosity.

6. The process according to claim 1, wherein the product is a plumbing valve or fitting.

7. A process comprising:

combining copper and ferromanganese as a source of manganese to form a copper-manganese alloy, the ferromanganese containing about 75 to 80 weight percent manganese with the balance carbon, iron, and incidental impurities, the copper-manganese alloy containing copper and manganese and having an amount of manganese that is at least 32 weight percent and not more than 40 weight percent of a combined total amount of the copper and manganese in the copper-manganese alloy; and casting the copper-manganese alloy by multidirectional solidification to produce a product in the form of a casting, the copper-manganese alloy having a composition sufficiently near the congruent melting point of the Cu—Mn alloy system to sufficiently avoid dendritic growth during the multidirectional solidification of the copper-manganese alloy to avoid the formation of microporosity attributable to dendritic growth, the product having a cast microstructure having a cellular and/or planar solidification structure and having multidirectional columnar grains.

8. The process according to claim 7, wherein the ferromanganese is solid ferromanganese, the copper has not been deoxidized, and the combining step comprises generating heat by oxidation of the carbon in the ferromanganese to melt and dissolve the ferromanganese.

9. The process according to claim 1, wherein the copper-manganese alloy contains iron.

10. The process according to claim 7, wherein the copper-manganese alloy contains at least 32 weight percent and not more than 36 weight percent manganese.

11. The process according to claim 7, wherein the copper-manganese alloy further contains one or more of nickel, aluminum, silicon, tin, and lead.

12. The process according to claim 7, wherein the copper-manganese alloy does not contain lead.

13. The process according to claim 7, wherein the product is a plumbing valve or fitting.

14. The process according to claim 7, wherein the product is free of microporosity.

15. The process according to claim 1, wherein the casting step is performed in a steel mold.

16. The process according to claim 15, wherein the casting step includes melting the copper-manganese alloy to form a melt and pouring the melt into the steel mold, wherein the temperature of the melt decreases toward an ambient temperature established by the steel mold.

17. The process according to claim 1, wherein the casting step includes melting the copper-manganese alloy to form a melt and pouring the melt into a mold, wherein the temperature of the melt decreases toward an ambient temperature established by the mold.

18. The process according to claim 1, wherein heat is generated by oxidation of carbon in the ferromanganese to melt and dissolve the ferromanganese.

19. A process comprising:

combining copper that has not been deoxidized and solid ferromanganese containing carbon to form a copper-manganese alloy containing copper and manganese and having an amount of manganese that is at least 32 weight percent and not more than 40 weight percent of a combined total amount of the copper and manganese in the copper-manganese alloy, wherein heat is generated by oxidation of the carbon in the ferromanganese to melt and dissolve the ferromanganese;

melting the copper-manganese alloy to form a melt;

pouring the melt into a multidirectional solidification mold to cast a product via multidirectional solidification in the form of a casting, wherein the temperature of the melt decreases toward an ambient temperature established by the mold, the copper-manganese alloy having a composition sufficiently near the congruent melting point of the Cu—Mn alloy system to sufficiently avoid dendritic growth during the multidirectional solidification of the copper-manganese alloy to avoid the formation of microporosity attributable to dendritic growth, the product having a cast microstructure having a cellular and/or planar solidification structure and having multidirectional columnar grains.

* * * * *